United States Patent [19]

Hakansson et al.

[11] Patent Number: 4,732,165

[45] Date of Patent: Mar. 22, 1988

[54] WRAPPING MECHANISM FOR CIGARETTE ROD MAKING AND LIKE MACHINES

[75] Inventors: Gerhard Hakansson; Günter Böttcher; Klaus-Dieter Mallon, all of Hamburg, Fed. Rep. of Germany

[73] Assignee: Körber AG, Hamburg, Fed. Rep. of Germany

[21] Appl. No.: 892,137

[22] Filed: Jul. 30, 1986

[30] Foreign Application Priority Data

Aug. 2, 1985 [DE] Fed. Rep. of Germany ..... 3527837

[51] Int. Cl.[4] ..... A24C 5/18; A24C 5/52

[52] U.S. Cl. ..... 131/105; 131/66.1; 131/84.1

[58] Field of Search ..... 131/84.1, 58, 65, 79, 131/66.1, 66.2, 77, 105

[56] References Cited

U.S. PATENT DOCUMENTS

| | | | |
|---|---|---|---|
| 302,521 | 7/1884 | Pollard | 131/66.1 |
| 503,582 | 8/1893 | Duke | 131/66.1 |
| 1,723,942 | 8/1929 | Koerner | 131/84.1 |
| 2,235,853 | 3/1941 | Smith | 131/66.1 |
| 2,617,426 | 11/1952 | Patterson | 131/79 |
| 2,796,810 | 6/1957 | Muller | 131/84.1 |
| 4,164,229 | 8/1979 | Hart | 131/66.2 |
| 4,543,967 | 10/1985 | Labbe | 131/84.3 |
| 4,598,719 | 7/1986 | Mattei et al. | 131/84.1 |

*Primary Examiner*—V. Millin
*Assistant Examiner*—H. Macey
*Attorney, Agent, or Firm*—Peter K. Kontler

[57] ABSTRACT

The sizing part of the wrapping mechanism in a cigarette rod making machine has a channel-shaped member with a guide surface extending between a straight edge and a U-shaped edge and composed of an infinite number of straight lines each of which connects a point on one of the edges with a point of the other edge. The channel-shaped member cooperates with a tongue whose sides define with the adjacent mutually inclined sections of the guide surface two gaps of constant width for the passage of the marginal portions of garniture tape which is used to drape the web of cigarette paper or other wrapping material around a filler of tobacco or filter material.

9 Claims, 7 Drawing Figures

WRAPPING MECHANISM FOR CIGARETTE ROD MAKING AND LIKE MACHINES

BACKGROUND OF THE INVENTION

The invention relates to rod forming machines of the tobacco processing industry in general, and more particularly to improvements in wrapping mechanisms (also called sizing parts) of such machines. Typical examples of rod forming machines of the tobacco processing industry which employ wrapping mechanisms are machines which convert a stream of tobacco particles into a continuous cigarette rod and machines which convert a stream of fibrous filter material into a continuous filter rod.

The invention will be described with reference to the wrapping mechanism of a cigarette rod making machine. However, it is to be understood that the wrapping mechanism which embodies the present invention can be used with equal advantage in machines which are designed to turn out cigarillos, cigars, filter rod sections or any other rod-shaped articles of the tobacco processing industry wherein a substantially cylindrical filler of tobacco or other fibrous material is surrounded by a wrapper of cigarette paper, imitation cork and other flexible strip-shaped wrapping material.

The wrapping mechanism of a cigarette rod making machine normally comprises a substantially channel-shaped member which cooperates with a so-called tongue to define a path for the travel of an elongated reach or stretch of an endless belt conveyor, known as garniture tape or garniture belt which serves to drape the web of cigarette paper or other suitable wrapping material around a continuous rod-like filler of natural tobacco, artificial tobacco, reconstituted tobacco or a mixture of several fibrous materials. The channel-shaped member has a guide surface which is designed in such a way that successive increments of the aforementioned reach or stretch of the garniture tape continuously undergo gradual deformation so that a flat portion of the stretch is converted into a substantially U-shaped body which surrounds the web of wrapping material at three sides in order to partially convert the originally flat web of wrapping material into a tube. As a rule, one marginal portion of the unfinished tube extends outwardly and away from the other marginal portion so that it can be coated with a suitable adhesive prior to bonding it to the other marginal portion. The marginal portions form the customary seam which extends in parallelism with the longitudinal axis of the resulting cigarette rod. The rod is subdivided into plain cigarettes of unit length or multiple unit length during travel through a cutter known as cutoff.

A drawback of conventional wrapping mechanisms (sizing parts) of cigarette rod making and other machines of the tobacco processing industry is that the shaping of the aforementioned guide surface on the channel-shaped member requires a substantial amount of work in a complex machine which must be operated by a skilled artisan. As a rule, the guide surface is configurated in such a way that it resembles the letter V whose legs define a relatively large angle at the inlet end of the wrapping mechanism. The legs gradually slope toward each other so as to reduce the angle therebetween. The cross-sectional outline of the guide surface at the outlet end of a conventional channel-shaped member resembles the letter U. Such guide surface can be said to consist of a large number of relatively short surfaces extending substantially tangentially of the cylindrical peripheral surface of the filler which is caused to travel through the wrapping mechanism. Otherwise stated, the individual short surfaces which together constitute the guide surface of a conventional channel-shaped member extend substantially helically of a cylinder with a radius corresponding to the radius of the cigarette rod which issues when the wrapping mechanism. The making of the guide surface is a complex, tedious, and time-consuming procedure. Furthermore, it is not possible to produce two or more guide surfaces of identical or practically identical shape.

OBJECTS AND SUMMARY OF THE INVENTION

An object of the invention is to provide a novel and improved wrapping mechanism for use in a cigarette rod making or like machine of the tobacco processing industry.

Another object of the invention is to provide a novel and improved sizing part which can be used in a cigarette making, filter rod making or like machine of the tobacco processing industry.

A further object of the invention is to provide a novel and improved channel-shaped member which can be used in the wrapping mechanism of the above-outlined machine.

Still another object of the invention is to provide a novel and improved combination of a channel-shaped member, a tongue and a garniture tape for use in the wrapping mechanism of a cigarette rod making, filter rod making or like machine.

Another object of the invention is to provide a channel-shaped member having a guide surface whose configuration matches exactly the configuration of a predetermined standard or ideal guide surface.

One feature of the present invention resides in the provision of a wrapping mechanism for use in a rod making machine of the tobacco processing industry, such as a cigarette maker or filter rod making machine. The wrapping mechanism comprises a so-called sizing part including an elongated channel-shaped member having a first edge with a first outline (e.g., a straight outline), and a second edge which is remote from the first edge and has a second outline (e.g., a substantially U-shaped outline) differing in shape from the first outline, and a guide surface which extends between the two edges and has a configuration such that each of an infinite number of straight lines in the guide surface extends from one of an infinite number of portions of the first edge to one of an infinite number of portions of the second edge. The two edges can be located in parallel planes.

The guide surface of the channel-shaped member has mutually inclined first and second sections which can be located close to the second edge, and the sizing part further comprises a tongue which is disposed between the two sections and has first and second sides complementary to and adjacent the respective sections. The sides of the tongue and the respective sections of the guide surface define two relatively narrow clearances or gaps of substantially uniform width for the passage of the wrapping material and garniture tape of the wrapping mechanism.

Another feature of the invention resides in the provision of a sizing part for use in a rod making machine of the tobacco processing industry. The sizing part comprises a channel-shaped member having a first edge, a second edge which is remote from the first edge (one of the edges is or can be substantially straight and the other edge can have a substantially U- or V-shaped outline), and a guide surface provided on the channel-shaped member and extending between the two edges. The guide surface is composed of an infinite number of straight lines each of which connects one of an infinite number of points or portions on the first edge with one of an infinite number of points or portions on the second edge. The sizing part further comprises an endless flexible garniture belt having an elongated reach overlying and conforming to the guide surface, and means for driving the garniture belt in a direction from the first edge toward the second edge.

The sizing part further comprises a tongue which is adjacent the channel-shaped member. The guide surface of the channel-shaped member has mutually inclined first and second sections, and the tongue has first and second sides which are complementary to and are spaced apart from the respective sections of the guide surface. The two sides of the tongue and the respective sections of the guide surface define first and second gaps of substantially constant width, and the garniture belt has first and second marginal portions which extend into the respective gaps. The tongue is preferably adjacent the second edge of the channel-shaped member. The guide surface is preferably provided at the upper side of the channel-shaped member. The distance between the two edges of the channel-shaped member can be several times the length of the first or second edge.

The novel features which are considered as characteristic of the invention are set forth in particular in the appended claims. The improved wrapping mechanism itself, however, both as to its construction and the mode of making the same, together with additional features and advantages thereof, will be best understood upon perusal of the following detailed description of certain specific embodiments with reference to the accompanying drawing.

DESCRIPTION OF THE PREFERRED EMBODIMENTS

Figure 1:
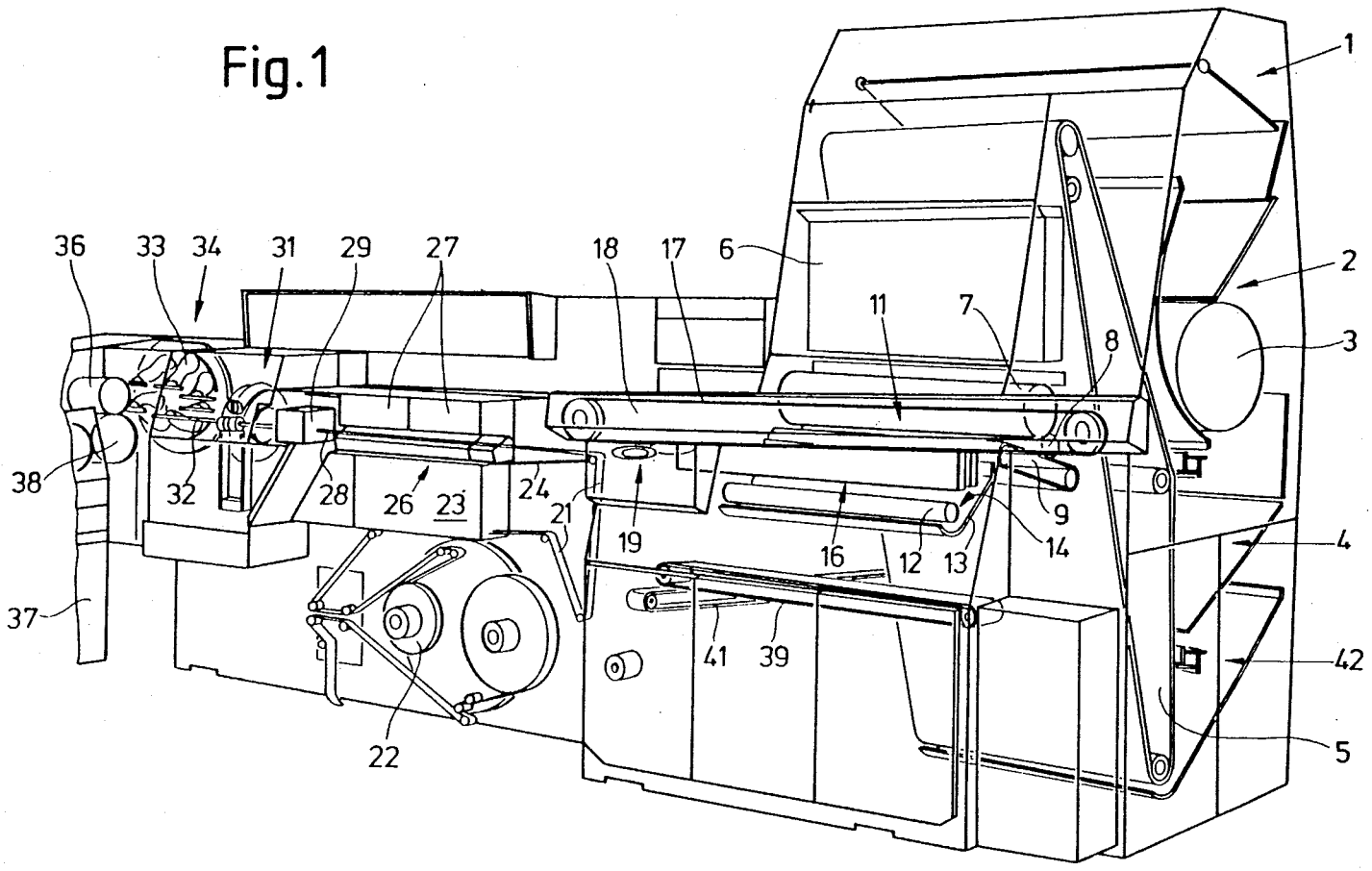
FIG. 1 is a perspective view of a cigarette rod making machine with a wrapping mechanism which embodies the invention.

FIG. 1 shows a cigarette rod making machine of the type known as PROTOS which is made and distributed by the assignee of the present application. The machine comprises a gate 1 which is designed to discharge batches of tobacco into a primary distributor 2. The lower portion of the distributor 2 is adjacent a rotor 3 which serves to transfer tobacco particles into a magazine 4 adjacent the ascending reach of an elevator conveyor 5 having equidistant pockets (not specifically shown) which transport batches of tobacco particles upwardly and dump the batches into an upright duct 6. The lower end portion of the duct 6 is adjacent a drum-shaped carded conveyor 7 which draws a continuous stream of tobacco particles and cooperates with a rapidly rotating picker roller 8 serving to propel the particles from the carding of the conveyor 7 onto an elongated and wide belt conveyor 9 which accumulates a wide but thin layer or carpet of tobacco particles. The conveyor 9 is driven at a constant speed and propels successive increments at the leading end of the carpet of tobacco particles into a classifying device 11 wherein the particles are propelled against a curtain of air streams. The arrangement is such that heavier tobacco particles traverse the curtain but the lighter (satisfactory) tobacco particles are deflected to enter a funnel 14 defined by a stationary wall 13 and a rotary drum-shaped carded conveyor 12. The conveyor 12 propels the satisfactory particles into a narrow tobacco channel 16 at the underside of a continuously driven foraminous endless tobacco stream forming belt conveyor 17. The lower reach of the conveyor 17 is adjacent a stationary suction chamber 18 which draws air through the conveyor 17 and thereby attracts the particles of tobacco to the underside of the lower reach. The resulting tobacco stream is equalized by a conventional trimming device 19 to be converted into a rod-shaped filler which is transferred onto a continuously running cigarette paper web 21 on the upper reach of a garniture tape 24 forming part of a wrapping mechanism 26 (also known as sizing part). The cigarette paper web 21 is drawn off a bobbin 22 and is caused to travel through a conventional imprinting mechanism 23 on its way toward the upper reach of the garniture tape 24.

The purpose of the wrapping mechanism 26 is to drape successive increments of the cigarette paper web 21 around the tobacco filler so as to form a continuous cigarette rod 28. The seam between the two overlapping marginal portions of the web 21 is heated or cooled (depending on the nature of the adhesive which is utilized in the cigarette rod making machine) in a so-called tandem sealer 27, and successive increments of the cigarette rod 28 are monitored by a density measuring device 29 of conventional design which is utilized to adjust the trimming device 19 below the lower reach of the stream forming conveyor 17.

The cigarette rod 28 passes through a conventional cutoff 31 wherein it is subdivided into a row of plain cigarettes 32 of unit length or multiple unit length. Successive cigarettes 32 are engaged by orbiting arms 33 of a transfer device 34 which delivers the cigarettes to a drum-shaped conveyor 36 in a filter tipping machine 37. The conveyor 36 delivers plain cigarettes 32 to a drum 38 cooperating with a rotary circular cutter (not specifically shown) to subdivide each plain cigarette 32 into two or more plain cigarettes of unit length. Such cigarettes are thereupon united with sections of a filter rod to form filter cigarettes of unit length or multiple unit length in a manner not forming part of the present invention.

FIG. 1 further shows belt conveyors 39 and 41 which transport surplus tobacco from the trimming device 19 into a container 42 below the magazine 4 and adjacent the ascending reach of the elevator conveyor 5. The aforementioned pockets of the conveyor 5 draw small quantities of returned surplus tobacco from the container 42 before they reach the magazine 4 wherein they are filled with tobacco particles supplied by the rotor 3.

Figure 4:
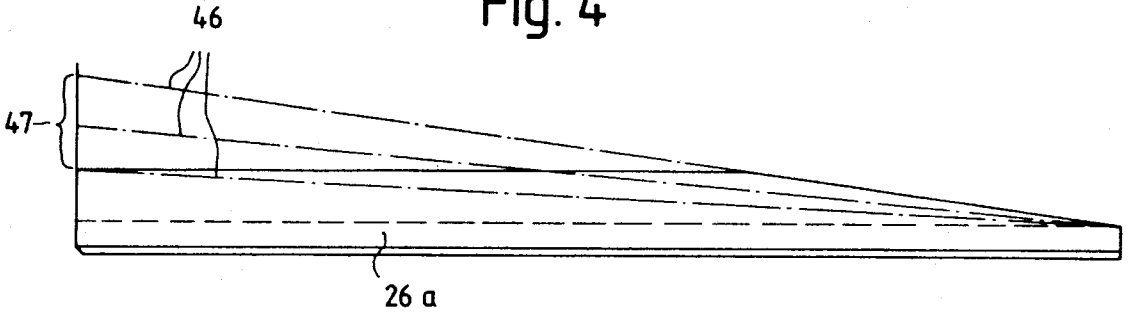
FIG. 4 is a side elevational view of the channel-shaped member.
Figure 3:
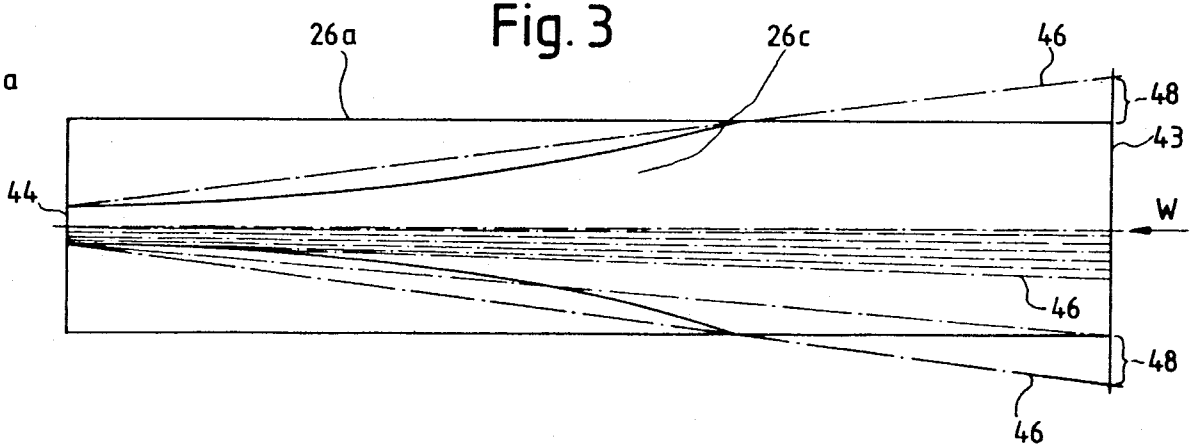
FIG. 3 is a plan view of the channel-shaped member.
Figure 5:
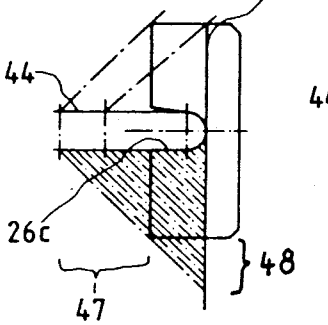
FIG. 5 is a view as seen in the direction of arrow W in FIG. 3.

The wrapping mechanism 26 comprises a lower portion including an elongated substantially channel-shaped member 26a (see FIGS. 4–6) and an upper portion constituted by or including a so-called tongue 26b. The upper side of the channel-shaped member 26e constitutes an elongated guide surface 26c which extends from a substantially straight edge 43 to a substantially U-shaped edge 44 of the member 26a. The edge 44 is located downstream of the edge 43, as seen in the direction of arrow W denoting the direction of travel of the upper reach of the garniture tape 24 along the guide surface 26c.

The garniture tape 24, the bobbin 22, the conveyors, and other moving parts of the cigarette rod making machine of FIG. 1 are driven by a prime mover (not specifically shown) which is installed in the housing, for example below the trimming device 19.

Figure 2A:
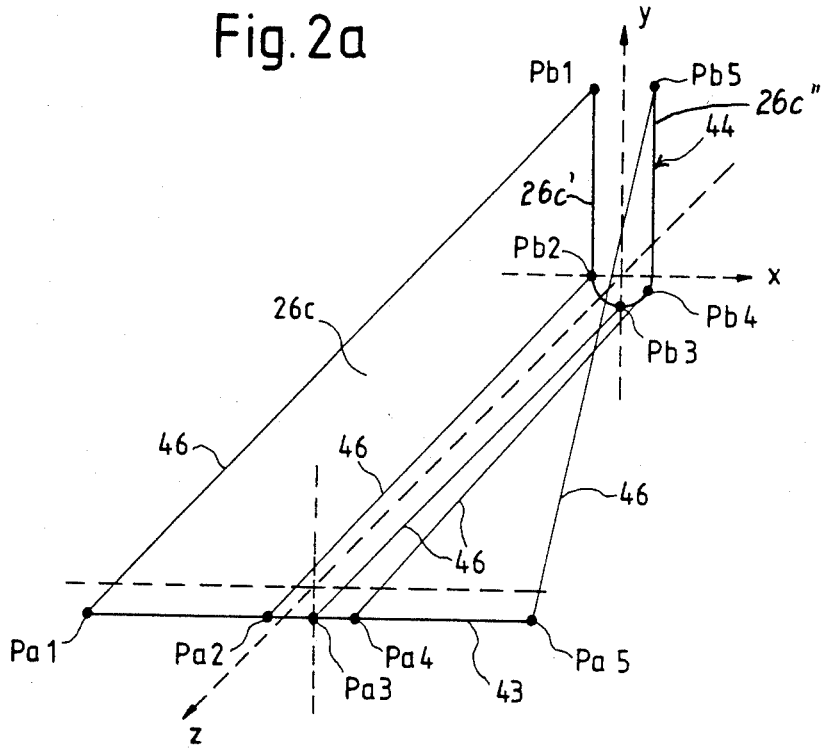
FIG. 2*a* is a perspective view of the guide surface on the channel-shaped member of the wrapping mechanism.
Figure 2B:
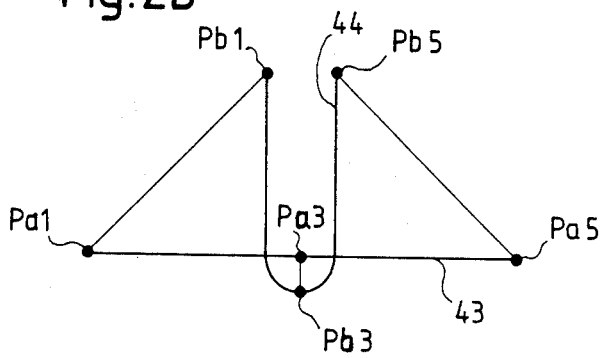
FIG. 2*b* is an end elevational view of the guide surface.

The configuration of the guide surface 26c is shown in FIGS. 2 and 2b. This surface is composed of an infinite number of straight lines 46 each of which connects a point Pa on the straight edge 43 with an equivalent point Pb on the U-shaped edge 44 of the channel-shaped member 26a. FIGS. 2a and 2b merely show a few straight lines 46 each of which extends between a point or edge portion at one end and a point or edge portion at the other end of the channel-shaped member 26a. The points Pa1 and Pa5 constitute the two outermost portions or end portions of the straight edge 43, and the points Pb1 and Pb5 constitute the outermost or end portions of the U-shaped edge 44. The points Pa2, Pa3 and Pa4 are located between the points Pa1 and Pa5, and the points Pb2, Pb3, and Pb4 are located between the points Pb1 and Pb5.

FIG. 2a shows the guide surface 26c in a coordinate system wherein the X-axis extends transversely of the longitudinal direction of the channel-shaped member 26a, the Y-axis extends vertically at right angles to the X-axis and substantially midway between two substantially parallel sections 26c' and 26c'' of the surface 26c in the region of the edge 44, and the axis Z extends in the longitudinal direction of the guide surface 26c and is parallel or nearly parallel to the straight lines connecting the points Pa2 and Pa4 with the points Pb2 and Pb4, respectively. As mentioned before, the guide surface 26c is composed of an infinite number of straight lines 46 of which only a few are actually shown in FIGS. 2a, 2b, 3 and 4. The edges 43, 44 are or can be located in two parallel vertical planes.

It will be seen that the generatrix of the guide surface 26c is a straight line.

FIGS. 2a and 2b show that the point Pb3 of the U-shaped edge 44 is located at a level below the corresponding or equivalent point Pa3 on the straight edge 43. However, it is equally within the purview of the invention to incline or configurate the guide surface 26c in such a way that the point Pb3 is located at the level of or above the level of the straight edge 43 and its point or portion Pa3.

FIGS. 3, 4, 5 and 6 show the channel-shaped member 26a in several views. The length of the member 26a in the direction of the arrow W can be several times the length of the straight edge 43 or the U-shaped edge 44. The reference characters 47 and 48 denote in FIG. 5 those portions of the channel-shaped member 26a which are not essential for the configuration of the guide surface 26c and may or may not be provided in the finished wrapping mechanism.

Figure 6:
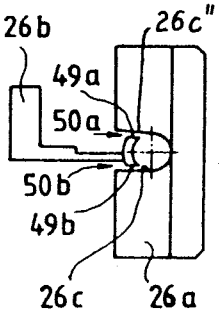
FIG. 6 shows the structure of FIG. 5 and the tongue of the sizing part.

FIG. 6 shows that the tongue 26b has two sides 49a and 49b which are adjacent and complementary to the sections 26c' and 26c'' of the guide surface 26c in the region of the U-shaped edge 44. The configuration of the sides 49a and 49b is analogous to that of the guide surface 26c, i.e., each of the sides 49a and 49b also consists of an infinite number of straight lines which can be drawn to extend from an edge at the inlet end to an edge at the outlet end of the tongue 26b. The side 49a defines with the adjacent section 26c' a first clearance or gap 50a, and a similar clearance or gap 50b is formed between the side 49b and the adjacent section 26c'' of te surface 26c. The gaps 50a and 50b are of substantially constant width and are substantially filled by the respective longitudinally extending marginal portions of the garniture tape 24 and the adjacent portions of the web 21 when the wrapping mechanism utilizing the channel-shaped member 26a and the tongue 26b is in actual use. The width of the gaps 50a and 50b is preferably constant all the way from the inlet and to the outlet end of the tongue 26b.

The wrapping mechanism or sizing part including the channel-shaped member 26a and the tongue 26b normally comprises one or more additional components which, together with tongue 26b, constitute the upper portion or half of the wrapping mechanism. Such additional components are known as "sizing related parts" and are not specifically shown in the drawing. One or more sizing related parts can be disposed adjacent the guide surface 26c upstream and/or downstream of the tongue 26b. If the mechanism 26 contains or comprises one or more sizing related parts, the sides of such parts are configurated in the same way as the sides 49a and 49b of the tongue 26b. In other words, each side of each sizing related part is also composed of an infinite number of straight lines in a manner analogous to that described in connection with the configuration of the guide surface 26c at the upper side of the channel-shaped member 26a.

An important advantage of the improved channel-shaped member 26a and of its guide surface 26c is that it does not necessitate an unnatural or complex deformation of the upper reach of the garniture tape 24. The garniture tape can undergo an expected or anticipated deformation during conversion of successive increments of its upper reach from a flat body in the region of the edge 43 into a substantially U-shaped body in the region of the edge 44. The same applies for the web 21 of wrapping material which overlies the upper reach of the tape 24. Such natural or anticipated deformation of the garniture tape 24 and web 21 is desirable and advantageous because it reduces the likelihood that the web 21 would be caused to develop wrinkles and/or other undesirable deformations.

Another important advantage of the improved wrapping mechanism is that the width of the gaps 50a and 50b can be readily selected in such a way that each of the gaps is practically filled by the respective marginal portion of the garniture tape 24 and the respective marginal portion of the running web 21. This reduces the likelihood of rapid contamination of the interior of the wrapping mechanism 26 by dust and other foreign particles.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. In a wrapping mechanism for use in a rod making machine of the tobacco processing industry, a sizing part including a channel-shaped member having a first edge with a first outline, a second edge remote from said first edge and having a second outline which differs in shape from said first outline, wherein one of said edges is a substantially straight edge, and a guide surface extending between said edges and having a configuration such that each of an infinite number of straight lines forming said surface extends from one of an infinite number of portions of said first edge to one of an infinite number of portions of said second edge.

2. The sizing part of claim 1, wherein one of said edges has a substantially U-shaped outline.

3. The sizing part of claim 1, wherein said guide surface has mutually inclined first and second sections, and further comprising a tongue disposed between said sections and having first and second sides complementary to and adjacent the respective sections, said sides and the respective sections defining two gaps of substantially constant width.

4. In a rod making machine of the tobacco processing industry, a sizing part comprising a channel-shaped member having a first edge, a second edge remote from said first edge, one of said edges being substantially straight and the other of said edges being substantially U-shaped, said member further having a guide surface extending between said edges and composed of an infinite number of straight lines each connecting one of an infinite number of points on said first edge with one of an infinite number of points on said second edge; an endless flexible garniture tape having an elongated reach overlying and conforming to said guide surface; and means for driving said tape in a direction from said first edge toward said second edge.

5. The sizing part of claim 4, further comprising a tongue adjacent said member, said guide surface having mutually inclined first and second sections and said tongue having first and second sides complementary to and adjacent the respective sections of said surface, said sides and the respective sections defining first and second gaps of substantially constant width and said tape having first and second marginal portions extending into the respective gaps.

6. The sizing part of claim 5, wherein said tongue is adjacent the second edge of said member.

7. The sizing part of claim 5, wherein said member has an upper side and an underside, said guide surface being located at the upper side of said member.

8. The sizing part of claim 4, wherein said member is elongated and the distance between said edges is several times the length of said first or second edge.

9. The sizing part of claim 4, wherein said edges are disposed in parallel planes.

* * * * *